United States Patent [19]

Manz et al.

[11] Patent Number: 4,805,416

[45] Date of Patent: Feb. 21, 1989

[54] REFRIGERANT RECOVERY, PURIFICATION AND RECHARGING SYSTEM

[75] Inventors: Kenneth W. Manz, Paulding; Roger D. Shirley, W. Unity, both of Ohio; Richard D. Parks, Horton, Mich.; Dennis W. Hickman, Edon, Ohio

[73] Assignee: Kent-Moore Corporation, Warren, Mich.

[21] Appl. No.: 157,579

[22] Filed: Feb. 19, 1988

Related U.S. Application Data

[63] Continuation-in-part of Ser. No. 117,098, Nov. 4, 1987, Pat. No. 4,768,347.

[51] Int. Cl.[4] ..... F25B 45/00

[52] U.S. Cl. ..... 62/292; 62/474

[58] Field of Search ..... 62/149, 292, 77, 85, 62/474; 137/544; 210/195.1, 257.1

[56] References Cited

U.S. PATENT DOCUMENTS

| | | | |
|---|---|---|---|
| 2,044,096 | 6/1936 | Moran | 210/257.1 X |
| 2,341,429 | 2/1944 | Elsey | 62/77 |
| 2,865,442 | 12/1958 | Halford et al. | 210/103 |
| 2,917,110 | 12/1959 | Brohl | 137/544 X |
| 3,915,857 | 10/1975 | Olson | 210/257.1 X |
| 4,110,998 | 9/1978 | Owen | 62/292 X |
| 4,261,178 | 4/1981 | Cain | 62/149 |

*Primary Examiner*—William E. Tapolcai
*Attorney, Agent, or Firm*—Barnes, Kisselle, Raisch, Choate, Whittemore & Hulbert

[57] ABSTRACT

A system for recovering, purifying and recharging refrigerant in a refrigeration system comprises a refrigerant compressor having an input connected through an evaporator and a recovery control valve to a refrigeration system from which refrigerant is to be recovered, purified and recharged. A condenser is connected to the output of the compressor in heat exchange relation with the evaporator for liquifying refrigerant from the compressor output. Refrigerant liquified in the condenser is fed to a first port of a refrigerant storage container. During a purification cycle, refrigerant is circulated from a second port of the refrigerant storage container in a closed path through a circulation valve and a filter for removing water and other contaminants, and then returned to the first container port. The refrigeration system from which refrigerant has been recovered is evacuated to atmosphere through a vacuum valve. Following such evacuation, the second port of the refrigerant storage container is connected through a recharging valve to the refrigeration of system for feeding refrigerant from the storage container to the refrigeration system, and thereby recharging the refrigeration system for normal use.

45 Claims, 5 Drawing Sheets

REFRIGERANT RECOVERY, PURIFICATION AND RECHARGING SYSTEM

This application is a continuation-in-part of application Ser. No. 117,098 filed Nov. 4, 1987, now U.S. Pat. No. 4,768,347.

The present invention is directed to devices for recovering refrigerant from refrigeration systems such as air conditioning and heat pump systems, purification of recovered refrigerant for removal of water and other contaminants, storage of used and/or purified refrigerant, and recharging of the refrigeration system using stored and purified refrigerant.

BACKGROUND OF THE INVENTION

Many scientists contend that release of halogen refrigerants into the atmosphere deleteriously affects the ozone layer which surrounds and protects the earth from ultraviolet solar radiation. Recent international discussions and treaties, coupled with related regulations and legislation, have renewed interest in devices for recovery and storage of used refrigerants from refrigeration systems for later purification and reuse or for proper disposal. U.S. Pat. No. 4,261,178, assigned to the assignee hereof, discloses a refrigerant recovery system in which the input of a compressor is coupled through an evaporator and through a manual valve to the refrigeration system from which refrigerant is to be recovered. The compressor output is connected through a condenser to a refrigerant storage container. The condenser and evaporator are combined in a single assembly through which cooling air is circulated by a fan. Content of the storage container is monitored by a scale on which the container is mounted for sensing weight of liquid refrigerant in the container, and by a pressure switch coupled to the fluid conduit between the condenser and the container for sensing vapor pressure within the storage container. A full-container condition sensed at the scale or a high-pressure condition sensed at the pressure switch terminates operation of the compressor motor. A vacuum switch is positioned between the inlet valve and the evaporator for sensing evacuation of refrigerant from the refrigeration system and automatically terminating operation of the compressor motor.

U.S. Pat. No. 4,441,330, assigned to the assignee hereof, discloses a system for recovery, purification and recharging of refrigerant in a refrigeration system in which a compressor is connected by solenoid valves through a condenser/evaporator unit and an oil separator to a refrigeration system from which refrigerant is to be recovered, and to a storage tank or container for storing recovered refrigerant. A separate liquid pump is controlled by microprocessor-based electronics to extract refrigerant from the storage container, circulate the refrigerant through a filter and purification unit, and then to recharge the refrigeration system from refrigerant in the purification unit. A separate vacuum pump is connected to the refrigeration system by solenoid valves to evacuate the refrigeration system to atmosphere after recovery of refrigerant therefrom and during the refrigerant purification operation.

U.S Pat. No. 4,688,388, assigned to the assignee hereof, discloses apparatus for service and recharge of refrigeration equipment, with particular application to automotive air conditioning equipment. A vacuum pump, and oil and refrigerant charge containers are housed within a portable enclosure and configured for selective connection by electrically operated solenoid valves to refrigeration equipment under service The refrigerant and oil containers are carried by a scale which provides electrical output signals as a function of weight of refrigerant and oil remaining in the containers. A microprocessor-based controller receives the scale signals and control signals from an operator panel for automatically cycling through vacuum, oil charge and refrigerant charge stages in a programmed mode of operation. The microprocessor-based controller includes facility for operator programming of the vacuum time and oil and refrigerant charge quantities, and for self- or operator-implemented diagnostics. Operating conditions and stages are displayed at all times to the operator.

OBJECTS AND SUMMARY OF THE INVENTION

In prior art apparatus of the subject character or type, of which the above are exemplary, the processes of recovery, purification and recharging of the refrigeration system have generally been approached in separate apparatus, or in combined apparatus of such cost and complexity as to compromise utility in all but the most sophisticated of applications. In view of increasing interest in environmental protection, increasing regulation of refrigerant recovery, purification and recharging processes, and the increasing cost and declining supply of new refrigerant, there is a correspondingly increased need in the art for a refrigeration recovery, purification and recharging system of the described character which is economical to manufacture, which can be afforded by refrigeration system service centers of all sizes, which is compact and portable, and which can be readily operated by relatively unskilled personnel with minimum operator intervention.

A system for recovering, purifying and recharging refrigerant in a refrigeration system in accordance with presently preferred embodiments of the invention herein disclosed comprises a refrigerant compressor having an input connected through an evaporator and a recovery control valve to a refrigeration system from which refrigerant is to be recovered, purified and recharged. A condenser is connected to the output of the compressor in heat exchange relation with the evaporator for liquifying refrigerant from the compressor output. Refrigerant liquified in the condenser is fed to a first port of a refrigerant storage container. During a purification cycle, run either concurrently with or subsequent to refrigerant recovery through the compressor, evaporator and condenser, refrigerant is circulated from a second port of the refrigerant storage container in a closed path through a circulation valve and a filter unit for removing water and other contaminants, and then returned to the first container port. The refrigeration system from which refrigerant has been recovered is evacuated to atmosphere through a vacuum valve, either separately from or concurrently with the purification process. Following such evacuation, the second port of the refrigerant storage container is connected through a recharging valve to the refrigeration system for feeding refrigerant from the storage container to the refrigeration system, and thereby recharging the refrigeration system for normal use.

In accordance with various aspects or embodiments of the invention, the purification process is accomplished either by circulation of recovered and stored refrigerant through the compressor, condenser, evaporator and filter unit, or through a liquid pump having the filter unit disposed in a separate refrigerant path in parallel with the compressor. Likewise, in various aspects or embodiments of the invention, the refrigeration system is evacuated following refrigerant recovery either using a separate vacuum pump, or by continued operation of the refrigerant recovery compressor and connection of the output thereof to atmosphere rather than to the refrigerant storage container. Following the evacuation process, the refrigeration system is recharged either by direct connection to the refrigerant storage container, whereby refrigerant is drawn into the evacuated refrigeration system through the combined effect of low system pressure and latent heat in the storage container, or by connection of the refrigeration system to the storage tank through a refrigerant pump. Such refrigerant pump may comprise the refrigerant recovery compressor or a separate liquid pump.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

The disclosures of parent application Ser. No. 117,098 filed Nov. 4, 1987 and of U.S. Pat. No. 4,688,388, both discussed above, are incorporated herein by reference.

Figure 1:
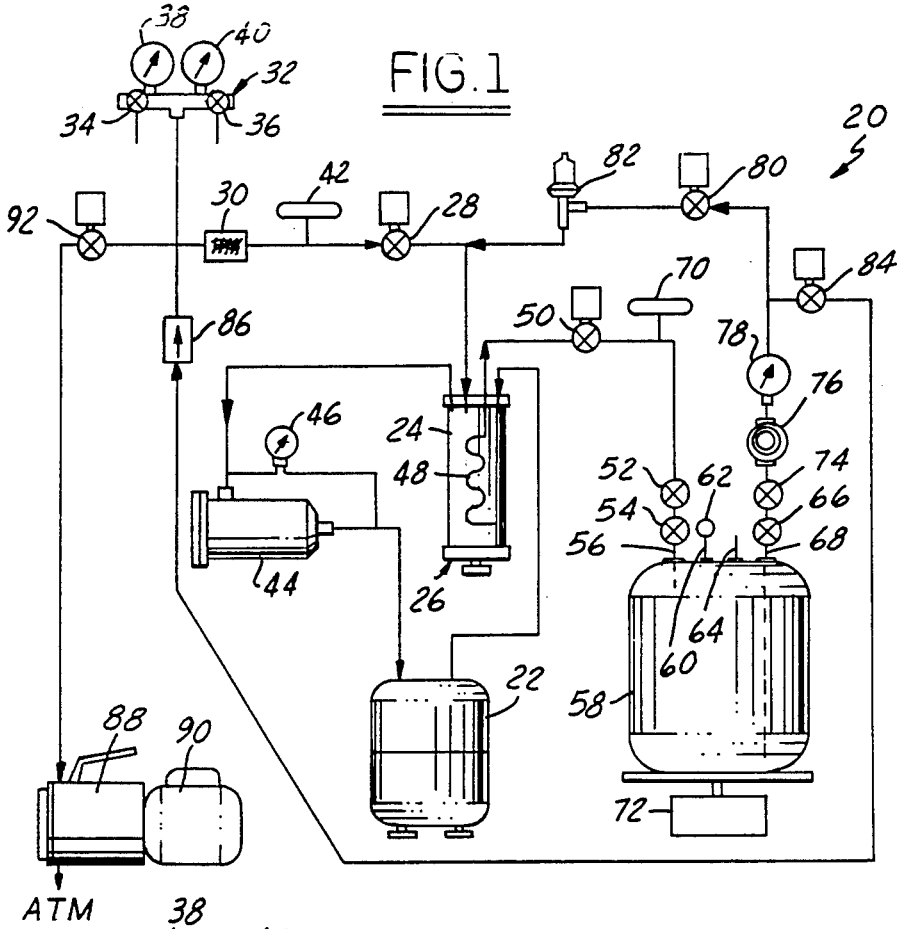
FIG. 1 is a schematic diagram of a refrigerant recovery, purification and recharging system in accordance with one presently preferred embodiment of the invention.

FIG. 1 illustrates a presently preferred embodiment of a refrigerant recovery, purification and recharging system 20 as comprising a compressor 22 having an inlet which is coupled to an input manifold 32 through the evaporator section 24 of a combined heat-exchange/oil separation unit 26, a recovery control solenoid valve 28 and a strainer 30. Manifold 32 includes facility for connection to the high pressure and low pressure sides of a refrigeration system from which refrigerant is to be recovered. Manifold 32 also includes the usual manual valves 34,36 and pressure gauges 38,40. A pressure switch 42 is connected between solenoid valve 28 and strainer 30, and is responsive to a predetermined low pressure to the compressor input from the refrigeration system to indicate removal or recovery of refrigerant therefrom. A replaceable core filter/dryer unit 44 of any suitable conventional type is connected in series between evaporator section 24 of unit 26 and the input of compressor 22. A differential pressure gauge 46 is connected across filter/dryer unit 44 to indicate pressure drop across unit 44 above a preselected threshold, which may be marked on the pressure indicator, and thereby advise an operator to replace the filter/dryer core of unit 44.

The outlet of compressor 22 is connected through the condenser portion 48 of heat-exchange/oil-separation unit 26, through an electrically operated solenoid valve 50 and through a pair of manual valves 52,54, in series, to the vapor inlet port 56 of a refillable refrigerant storage container 58. Container 58 is of conventional construction and includes a second port 60 for coupling to a suitable fill level indicator 62, a pressure relief port 64 and a manual liquid valve 66 connected to a liquid port 68. A suitable container 58 is marketed by Manchester Tank Company under the trademark ULTRALINE and includes valves 54,66, a pressure relief valve at port 64 and a fill indicator 62 coupled to port 60 as part of the overall assembly. A pressure switch 70 is connected between solenoid valve 50 and manual valve 52, and is responsive to vapor pressure within container 58 with valves 52,54 open to indicate an excessive vapor pressure of predetermined level therewithin To the extent thus far described, with the exception of filter/dryer unit 44 and gauge 46, the embodiment of FIG. 1 is similar to the refrigerant recovery and storage system disclosed in the parent to the present application identified above.

Container 58 is mounted on a scale 72 which provides an output signal to the system control electronics (FIG. 9) indicative of weight of refrigerant within container 58. Container liquid port 68 is connected through manual valve 66 and, in series, through a further manual valve 74, a moisture indicator 76, a pressure gauge 78, an electrically operated recirculation solenoid valve 80 and an expansion valve 82, to the input to evaporator section 24 of unit 26 in parallel with refrigerant recovery solenoid valve 28. An electrically operated refrigerant charging solenoid valve 84 is connected to gauge 78 in parallel with valve 80 for selectively feeding refrigerant from tank 58 through a check valve 86 to manifold 32. A vacuum pump 88 with associated pump-drive motor 90 is connected through an electrically operated vacuum solenoid valve 92 to manifold 32 for selectively evacuating to atmosphere a refrigeration system coupled to manifold 32.

In operation of the embodiment of the invention illustrated in FIG. 1, manifold 32 is first connected to a refrigeration system—e.g., an air conditioning system or heat pump system—from which refrigerant is to be recovered. With container 58 connected as shown in FIG. 1, and with all manual valves 52,54,66 and 74 open, solenoid valves 28,50 and compressor 22 are energized by the control electronics (FIG. 9) in an initial refrigerant recovery mode of operation. Refrigerant is thereby drawn from the refrigeration system to which manifold 32 is connected through strainer 30, valve 28, evaporator section 24 of combined unit 26 and filter/dryer unit 44 to the compressor inlet. Recovered refrigerant is fed from the compressor outlet through condenser section 48 of combined unit 26 where heat is exchanged with input refrigerant to evaporate the latter and condense the former, and thence through valve 50 to tank 58. When substantially all of the refrigerant has been withdrawn from the refrigeration system to which manifold 32 is connected, recovery pressure switch 42 indicates a low system pressure condition to the control electronics, which then closes valve 28. If refrigerant purification is desired, system operation then proceeds to the purification mode of operation. If a high vapor pressure within container 58 opens pressure switch 70, the refrigerant recovery operation is automatically terminated.

In the refrigerant purification mode of operation, refrigerant recirculation valve 80 is opened by the control electronics, while valve 50 remains open and compressor 22 remains energized. Liquid refrigerant is drawn from container port 68 through valve 80 and through expansion valve 82 to evaporator section 24 of heat exchange unit 26. Expansion valve 82 most preferably is of the automatic type preset at suitable temperature, such as 32° F. The refrigerant circulates through filter/dryer unit 44, compressor 22, condenser section 48 of heat exchange unit 26, and is returned to vapor port 56 of container 58. This continuous circulation and purification process proceeds until gauge 76 indicates removal of all water from the circulating refrigerant. In this connection, gauge 76 may be either of the type visually observable by an operator for manual termination of the purification cycle, or may be of automatic type coupled to the control electronics (FIG. 9) for automatic termination of the purification process when a predetermined moisture level is indicated. When gauge 76 indicates purification of the circulating refrigerant, compressor 22 is de-energized and valves 50,80 are closed.

Where the refrigeration system to which manifold 32 is connected is to be recharged following the recovery and purification cycles, a recharging mode of operation is entered. Vacuum solenoid valve 92 is first opened and vacuum pump 88 energized by the control electronics for evacuating the refrigeration system to atmosphere. This may be accomplished in accordance with a preferred mode of operation simultaneously with the purification process. When the refrigeration system has been evacuated for a predetermined time duration preset in the control electronics (FIG. 9), valve 92 is closed and pump motor 90 is de-energized. When the purification cycle discussed above is completed, recharge solenoid valve 84 is opened by the control electronics and refrigerant is drawn from container 58 by the combined effect of low pressure within the evacuated refrigeration system to be recharged and latent heat within container 58 following the purification process. Solenoid valve 84 remains open and the charging cycle continues until a predetermined refrigerant charge has been transferred to the refrigeration system, as indicated by scale 72 to the control electronics (FIG. 9), at which point solenoid valve 84 is closed and the charging cycle is terminated. Refrigerant in the system to which manifold 32 has been connected has thus been recovered, purified and recharged, and the refrigeration system may be disconnected for use.

Figure 2:
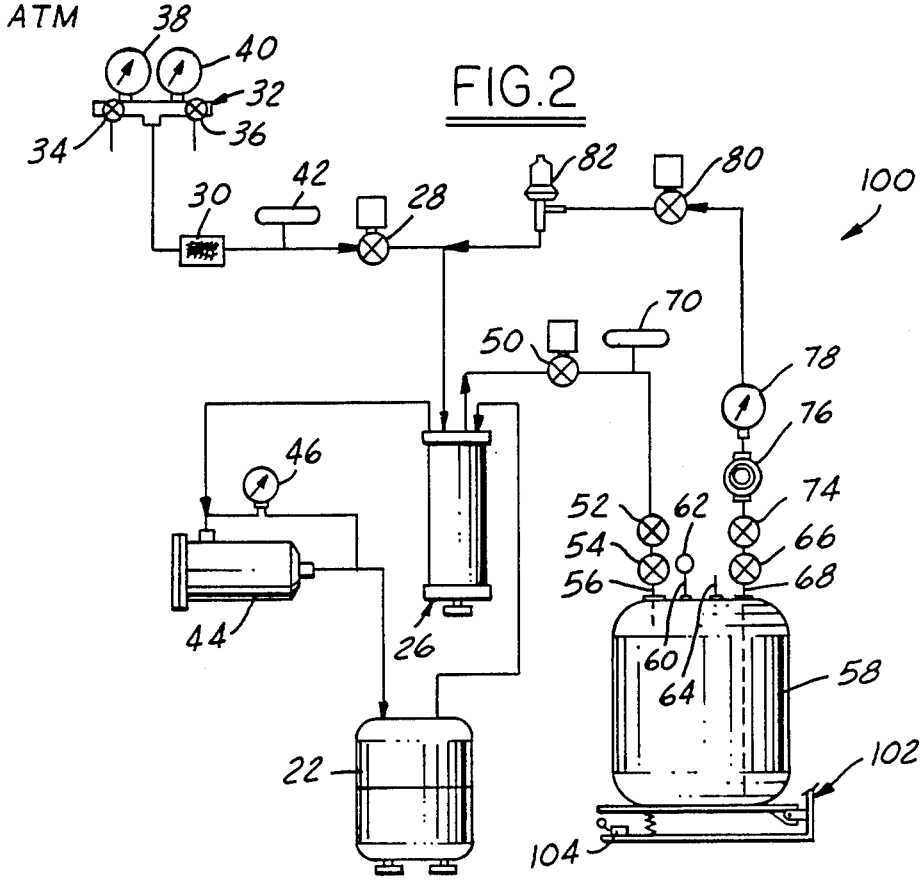
FIGS. 2–8 are schematic diagrams of respective alternative embodiments of the invention.

FIGS. 2–8 schematically illustrate respective modified embodiments of the invention. Elements in FIGS. 2–8 corresponding to those hereinabove described in detail in connection with FIG. 1, are indicated by correspondingly identical reference numerals. Only the differences between the various modified embodiments and the embodiment of FIG. 1 need be discussed. In the system 100 of FIG. 2, vacuum pump 88 and associated valve 92 and charging valve 84 (FIG. 1) have been eliminated. Scale 72 in the embodiment of FIG. 1, which provides a signal to the control electronics which continuously varies with contained refrigerant weight, is replaced by a scale 102 having a limit switch 104 to indicate a predetermined container weight corresponding to a full container condition. System 100 of FIG. 2 is thus adapted for applications calling for recovery and purification of refrigerant, but where system refrigerant recharging is not required.

Figure 3:
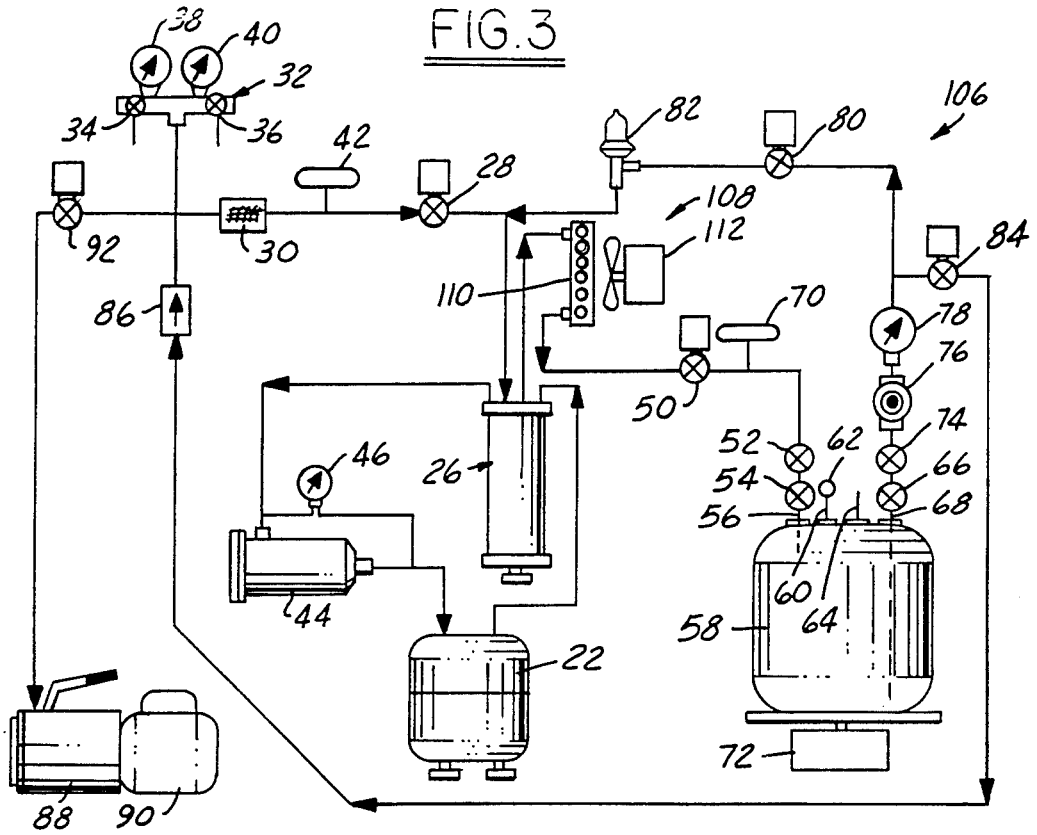

In the recovery, purification and recharging system 106 of FIG. 3, a supplemental condenser 108, which includes a refrigerant coil 110 and an electrically operated fan 112, is connected between heat exchange unit 26 and solenoid valve 50. Where the purification cycle is to be operated for an extended time duration, such as operation overnight to purify an entire tank of recovered refrigerant, supplemental condenser 108 helps reduce thermal load on compressor 22. Fan 112 is connected to the control electronics (FIG. 9) for operation during the purification cycle.

Figure 4:
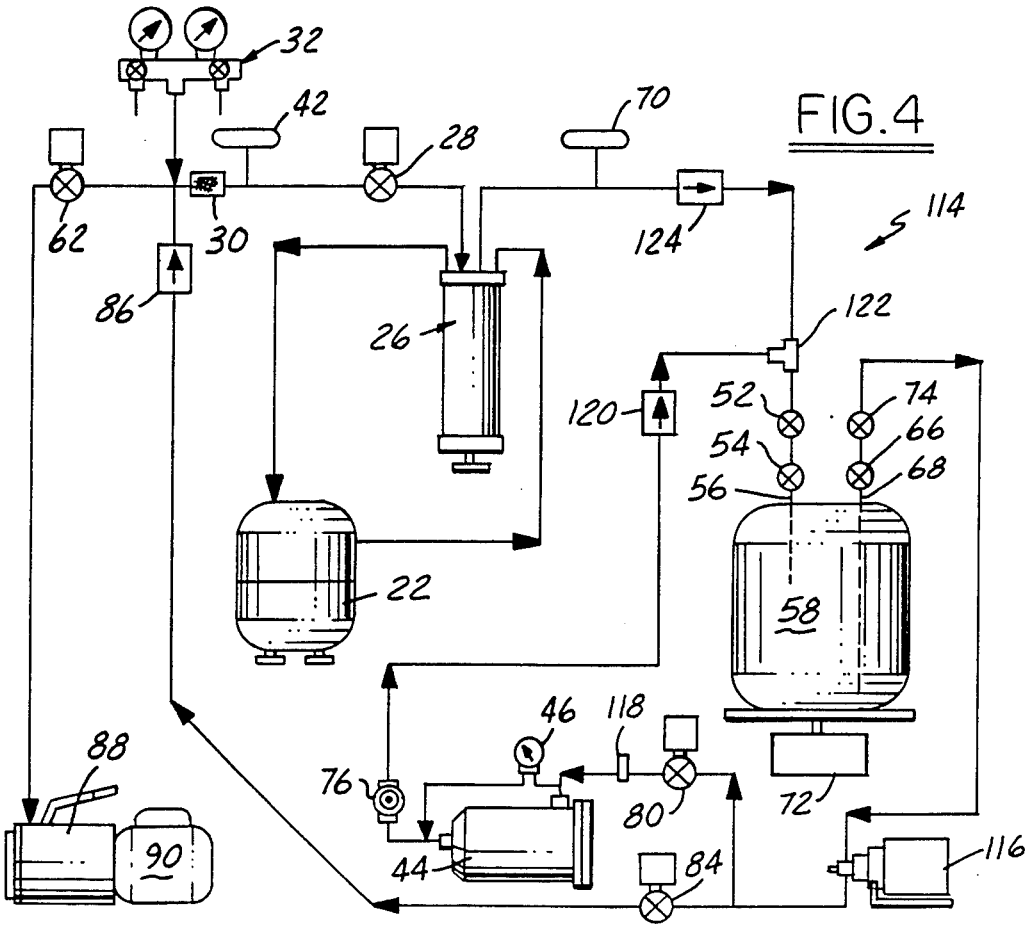

In the recovery, purification and recharging system 114 of FIG. 4, storage container liquid port 68 is connected through manual valves 66,74 to a liquid pump 116. Purification solenoid valve 80 and recharge solenoid valve 84 are connected in parallel at the output of liquid pump 116. Circulating refrigerant is fed during the purification cycle from solenoid valve 80 through a pressure relief valve 118 to filter/dryer unit 44 having differential gauge 46 connected thereacross, through moisture indicator 76 and through a check valve 120 to a T-coupling 122. A second check valve 124 is connected between heat exchange unit 26 and coupling 22, and solenoid valve 50 (FIGS. 1–3) is eliminated. Thus, in system 114 of FIG. 4, circulation of refrigerant during the purification cycle is accomplished by liquid motor 116 rather than compressor 22 as in the embodiments of FIGS. 1–3, and the refrigeration system to which manifold 32 is connected is recharged by liquid refrigerant fed under pressure thereto by pump 116, rather than by pressure differential and latent heat as in the embodiments of FIGS. 1 and 3.

Figure 5:
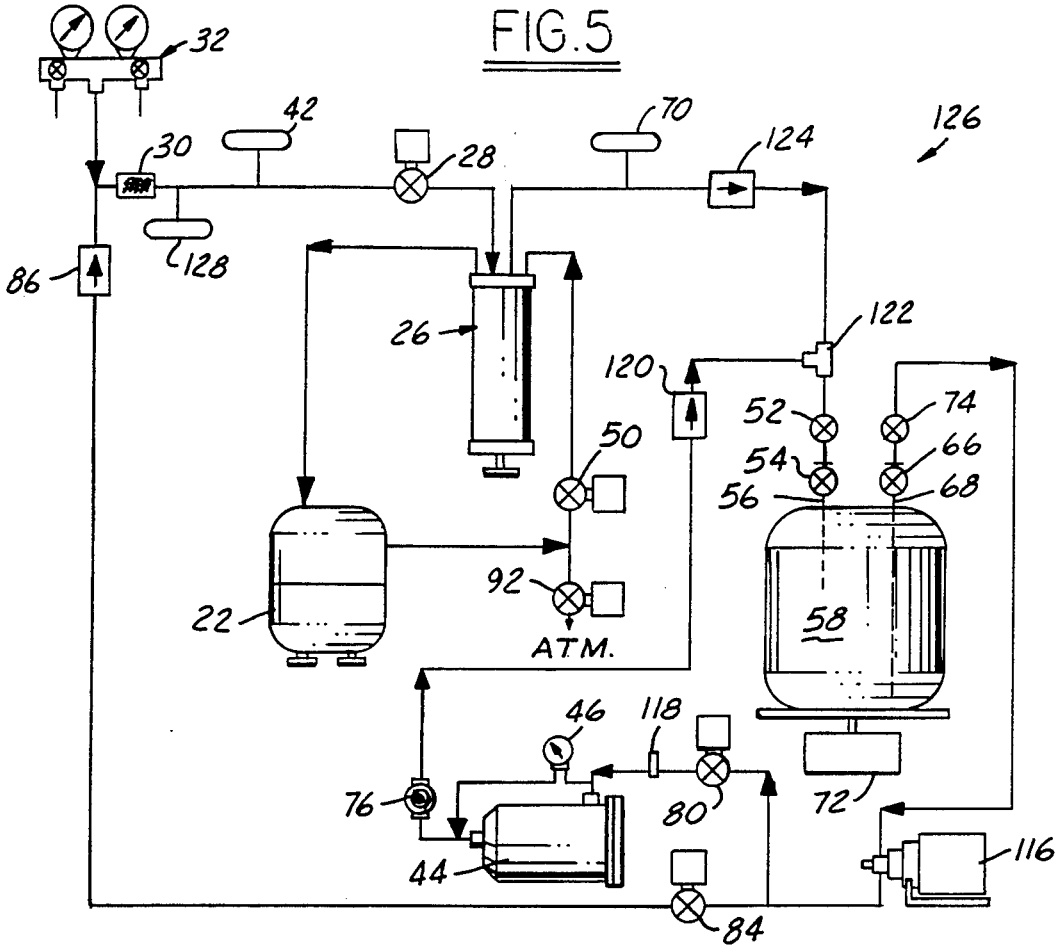

FIG. 5 illustrates a modification to the embodiment of FIG. 4 in which vacuum pump 88 and associated motor 90 are eliminated, and in which evacuation of the refrigeration system to atmosphere is accomplished by compressor 22. In the recovery, purification and recharging system 126 of FIG. 5, the tank-fill solenoid valve 50 is connected between the outlet of compressor 22 and heat exchange unit 26, and vacuum solenoid valve 92 is connected between the compressor output and atmosphere in parallel with valve 50. During a recovery cycle, solenoid valve 50 is opened and evacuation valve 92 is closed, and operation proceeds as hereinabove described in conjunction with FIGS. 1 and 3. During a purification cycle, both valves 50 and 92 are closed, and operation proceeds as described in conjunction with FIG. 4. During an evacuation cycle, which may be run concurrently with the purification cycle, valves 28,92 are opened and valve 50 is closed, and compressor 22 is operated by the control electronics to evacuate the refrigeration system connected to manifold 32 to atmosphere through valve 92. In the embodiment of FIG. 5, a vacuum pressure sensor 128 is connected between strainer 30 and pressure sensor 42 to sense a low or vacuum pressure at the refrigeration system, and to automatically terminate the vacuum operation when such low pressure is obtained.

Figure 6:
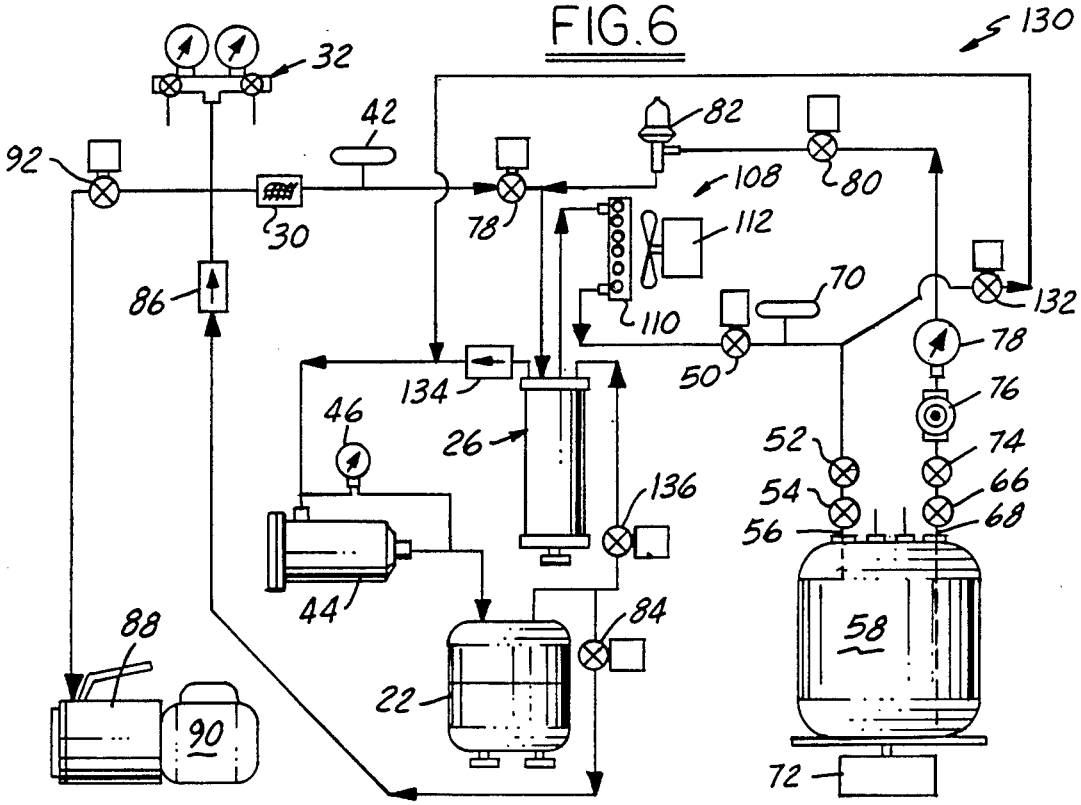

FIG. 6 illustrates a recovery, purification and recharging system 130 in which the recharging operation is accomplished by compressor 22 drawing refrigerant in vapor phase from container vapor port 56. A solenoid valve 132 is connected between the input to filter/dryer unit 44 and the junction of pressure sensor 70 and manual valve 52. A check valve 134 is connected at the evaporator output of heat exchange unit 26 in parallel with valve 132. A further solenoid valve 136 is connected between the output of compressor 22 and the condenser input of unit 26, system charging valve 84 being connected to the output of compressor 22 in parallel with valve 136. Recovery, purification and evacuation are accomplished in the embodiment of FIG. 6 as has been described in detail in connection with the embodiment of FIG. 3. When the system connected to manifold 32 is to be recharged with purified refrigerant, valves 28,50,80 and 136 are closed by the control electronics (FIG. 9), valves 84,132 are opened, and compressor 22 is energized to feed refrigerant vapor from container vapor port 56 through valve 132, filter/dryer unit 44, compressor 22, valve 84 and check valve 86 to the refrigeration system.

Figure 7:
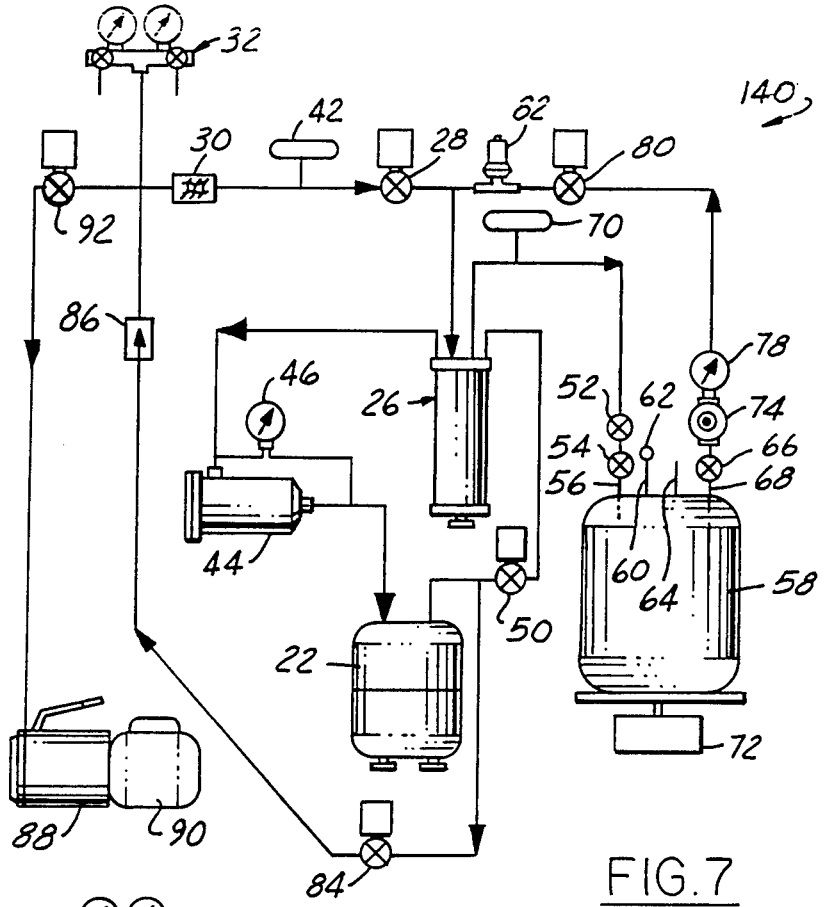

FIG. 7 illustrates a refrigerant recovery, purification and recharging system 140 in which recharging is accomplished by compressor 22 drawing refrigerant from liquid port 68 of storage container 58 through recirculation valve 80, expansion valve 82, heat exchange unit 26 and filter/dryer unit 44. Tank-fill solenoid valve 50 and systemcharging solenoid valve 84 are connected in parallel at the output of compressor 22. In system 140 of FIG. 7, recovery, purification and evacuation proceed as hereinabove described in connection with FIG. 1. When the refrigeration system is to be recharged, valve 50 is closed and valve 84 is opened, with valve 80 remaining open from the purification cycle. Refrigerant is drawn from container 58 by compressor 22 and expelled as vapor under pressure through valve 84 to the refrigeration system.

Figure 8:
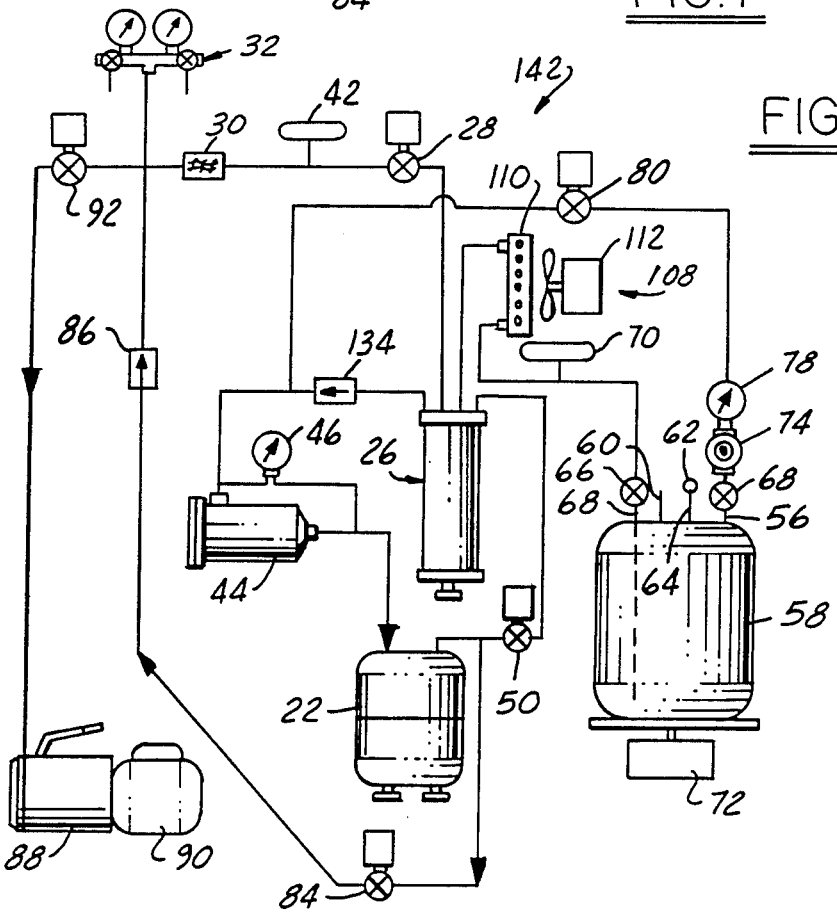

FIG. 8 illustrates a recovery, purification and recharging system 142 as a modification to system 140 of FIG. 7 wherein recirculating valve 80 is connected not to the evaporator input of heat exchange unit 26, but to the input of filter/dryer unit 44. As in system 130 of FIG. 6, a check valve 134 is connected at the output of heat exchange unit 26. It will be noted that liquid port 68 and vapor port 56 of storage container 58 are reversed in the embodiment of FI.. 8 as compared with the embodiments of FIGS. 1–7. That is, recovered and circulated refrigerant is fed to the liquid port 68 of container 58 rather than to the vapor port as in FIGS. 1–7, and refrigerant for purification and recharge is drawn from vapor port 56 rather than liquid port 68. Since compressor 22 draws refrigerant in vapor phase from container 58 during both the purification and recharging cycles, there is no need for the expansion valve 82 as in previous embodiments.

Figure 9:
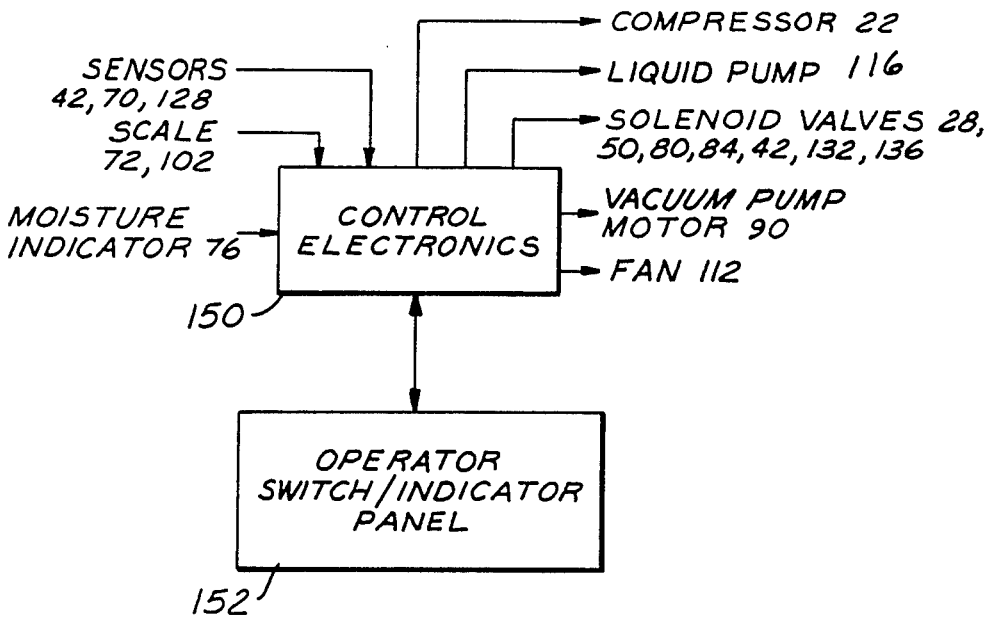
FIG. 9 is a block diagram of control electronics for use in conjunction with the embodiments of the invention illustrated in FIGS. 1–8.

FIG. 9 illustrates control electronics 150 for operating the several embodiments of the invention hereinabove described in conjunction with FIGS. 1–8. Control electronics 150 are connected to an operator switch/indicator panel 152 of any suitable character for implementing operation of the recovery, purification and recharging systems as hereinabove described and for indicating status of operation to the operator The parent application discloses relay-based control electronics for recovery and storage of refrigerant as hereinabove described. U.S. Pat. No. 4,688,388 discloses microprocessor-based electronics for controlled evacuation and recharging of refrigeration systems. Other suitable control electronics will be self-evident to persons skilled in the art in view of the foregoing discussion.

The invention claimed is:

1. A refrigerant recovery and purification system comprising: a refrigerant compressor having an input and an output; means including evaporator means for connecting said compressor input to a refrigeration system from which refrigerant is to be recovered; condenser means coupled to said compressor output in heat exchange relation to said evaporator means for liquifying refrigerant from said compressor output; refrigerant storage means having first and second ports; means for feeding liquid refrigerant from said condenser means to said first port; filter means for removing contaminants from refrigerant passing therethrough; and means for selectively circulating refrigerant in a closed path from said second port through said filter means to said first port.

2. The system set forth in claim 1 wherein said selectively-circulating means includes said compressor, and means for selectively connecting said compressor input to said second port.

3. The system set forth in claim 2 wherein said selectively-connecting means comprises means in parallel with said means for connecting said compressor input to said refrigeration system for selectively connecting said second port to said compressor input through said evaporator means.

4. The system set forth in claim 3 wherein said selectively-connecting means includes means connected between said second port and said evaporator means for vaporizing refrigerant passing therethrough.

5. The system set forth in claim 4 wherein said vaporizing means comprises an expansion valve.

6. The system set forth in claim 3 further comprising supplemental condensing means connected between said condenser means and said first port.

7. The system set forth in claim 6 wherein said supplemental condensing means comprises a condenser coil, a fan including a fan drive motor for circulating cooling air over said coil, and means for energizing said motor when refrigerant is circulated in said closed path from said second port to said compressor input.

8. The system set forth in claim 2 wherein said selectively-connecting means comprises means in parallel with said evaporator means for connecting said second port to said compressor input.

9. The system set forth in claim 8 wherein said refrigerant storage means has separate liquid and vapor ports, said liquid port comprising said first port and said vapor port comprising said second port.

10. The system set forth in claim 1 wherein said selectively-circulating means comprises pump means separate from said compressor having an input coupled to said second port, and means in parallel with said refrigerant-feeding means for connecting said pump through said filter means to said first port.

11. The system set forth in claim 1 wherein said filter means comprises means for removing water vapor from refrigerant passing therethrough.

12. The system set forth in claim 11 wherein said filter means further comprises means for indicating operating condition of said filter means as a function of pressure drop of refrigerant passing through said filter means.

13. The system set forth in claim 12 further comprising means for indicating water concentration of refrigerant exiting said filter means.

14. The system set forth in claim 1 further comprising means for recharging said refrigeration system from refrigerant in said container comprising: means connected to said refrigeration system for evacuating said system following removal of refrigerant therefrom, and means connecting said second port to said refrigeration system for selectively feeding refrigerant from said storage means to said refrigeration system following evacuation thereof by said evacuating means.

15. A system for recovering, purifying and recharging refrigerant in a refrigeration system comprising: a refrigerant compressor having an input and an output; means including evaporator means and a recovery control valve for connecting said compressor input to a refrigeration system from which refrigerant is to be recovered, purified and recharged; condenser means coupled to said compressor output in heat exchange relation to said evaporator means for liquifying refrigerant from said compressor output; refrigerant storage means having first and second ports; means for feeding refrigerant from said condenser means to said first port; filter means for removing contaminants from refrigerant passing therethrough; means including a circulation valve for selectively circulating refrigerant in a closed path from said second port through said filter means to said first port; means for evacuating said refrigeration system including a vacuum valve for selectively connecting said refrigeration system through said evacuating means; means including a recharging valve for selectively connecting said second port to said refrigeration system for selectively feeding refrigerant from said storage means to said refrigeration system; and means for selectively operating said recovery control valve, said circulation valve, said vacuum valve and said recharging valve for recovering refrigerant from said refrigeration system and storage thereof in said storage means, purification of refrigerant in said storage means by circulation through said filter means, evacuating said refrigeration system, and recharging said refrigeration system with refrigerant from said storage means.

16. The system set forth in claim 15 wherein said selectively operating means includes means for operating said evacuating means and said selectively-circulating means simultaneously.

17. The system set forth in claim 15 wherein said evacuating means comprises a vacuum pump and means in parallel with said evaporator means for selectively connecting said vacuum pump to said refrigeration system.

18. The system set forth in claim 15 wherein said evacuation means comprises said compressor and means for selectively venting said compressor output to atmosphere.

19. The system set forth in claim 15 wherein said selectively-feeding means comprises means for directly coupling said second port to said refrigeration system such that pressure in said refrigeration system following evacuation thereof and latent heat in refrigerant in said storage means passively propel refrigerant from said storage means through said second port to said refrigeration system.

20. The system set forth in claim 15 wherein said selectively-feeding means comprises pump means separate from said compressor.

21. The system set forth in claim 20 wherein said selectively-circulating means comprises said pump means having an input for selective connection to said second port and an output, first means for selectively connecting said output of said pump means through said filter means to said first port, and second means in parallel with said first means for selectively connecting said output of said pump means to said refrigeration system.

22. The system set forth in claim 15 wherein said selectively-feeding means comprises said compressor, means for selectively connecting said compressor input to said second port, and means in parallel with said condenser means for selectively connecting said compressor output to said refrigeration system.

23. The system set forth in claim 22 wherein said selectively-connecting means includes means connected between said second port and said compressor input for vaporizing refrigerant passing therethrough.

24. The system set forth in claim 22 wherein said selectively-circulating means includes said compressor and said means for selectively connecting said compressor input to said second port.

25. The system set forth in claim 24 wherein said selectively-connecting means comprises means in parallel with said means for connecting said compressor input to said refrigeration system for selectively connecting said second port to said compressor input through said evaporator means.

26. The system set forth in claim 24 wherein said selectively-connecting means comprises means in parallel with said evaporator means for connecting said second port to said compressor input.

27. The system set forth in claim 15 wherein said selectively circulating means includes said compressor, and means for selectively connecting said compressor input to said second port.

28. The system set forth in claim 27 wherein said selectively-connecting means comprises means in parallel with said means for connecting said compressor input to said refrigeration system for selectively connecting said second port to said compressor input through said evaporator means.

29. The system set forth in claim 28 wherein said selectively-connecting means includes means connected between said second port and said evaporator means for vaporizing refrigerant passing therethrough.

30. The system set forth in claim 28 further comprising supplemental condensing means connected between said condenser means and said first port.

31. The system set forth in claim 27 wherein said selectively-connecting means comprises means in parallel with said evaporator means for connecting said second port to said compressor input.

32. The system set forth in claim 31 wherein said refrigerant storage means has separate liquid and vapor ports, said liquid port comprising said first port and said vapor port comprising said second port.

33. The system set forth in claim 15 wherein said selectively-circulating means comprises pump means separate from said compressor having an input coupled to said second port, and means in parallel with said refrigerant-feeding means for connecting said pump through said filter means to said first port.

34. A refrigerant recovery and purification system comprising: a refrigerant compressor having an input and an output; means including evaporator means for connecting said compressor input to a refrigeration system from which refrigerant is to be recovered; condenser means coupled to said compressor output in heat exchange relation to said evaporator means for liquifying refrigerant from said compressor output; refrigerant storage means having first and second ports; means for feeding liquid refrigerant from said condenser means to said first port; filter means for removing water from refrigerant passing therethrough; means for selectively circulating refrigerant in a closed path from said second port through said filter means to said first port; means for indicating operating condition of said filter means as a function of pressure drop of refrigerant passing through said filter means; and means for indicating water concentration of refrigerant exiting said filter means.

35. A refrigerant recovery and purification system comprising: a refrigerant compressor having an input and an output; means including evaporator means for connecting said compressor input to a refrigeration system from which refrigerant is to be recovered; condenser means coupled to said compressor output in heat exchange relation to said evaporator means for liquifying refrigerant from said compressor output; refrigerant storage means having first and second ports; means for feeding liquid refrigerant from said condenser means to said first port; filter means for removing water from refrigerant passing therethrough; means for selectively circulating refrigerant in a closed path from said second port through said filter means to said first port; and means for recharging said refrigeration system from refrigerant in said container including: means connected to said refrigeration system for evacuating said system following removal of refrigerant therefrom, and means connecting said second port to said refrigeration system for selectively feeding refrigerant from said storage means to said refrigerant system following evacuation thereof by said evacuating means.

36. The system set forth in claim 35 wherein said evacuating means comprises a vacuum pump and means for selectively connecting said vacuum pump to said refrigeration system in parallel with said evaporator means.

37. The system set forth in claim 35 wherein said evacuating means comprises said compressor and means for selectively venting said compressor output to atmosphere.

38. The system set forth in claim 35 wherein said selectively-feeding means comprises means for directly coupling said second port to said refrigeration system such that pressure in said refrigeration system following evacuation thereof and latent heat in refrigerant in said storage means passively propel refrigerant from said storage means through said second port to said refrigeration system.

39. The system set forth in claim 35 wherein said selectively-feeding means comprises pump means separate from said compressor.

40. The system set forth in claim 39 wherein said selectively-circulating means comprises said pump means having an input for selective connection to said second port and an output, first means for selectively connecting said output of said pump means through said filter means to said first port, and second means in parallel with said first means for selectively connecting said output of said pump means to said refrigeration system.

41. The system set forth in claim 35 wherein said selectively-feeding means comprises said compressor, means for selectively connecting said compressor input to said second port, and means in parallel with said condenser means for selectively connecting said compressor output to said refrigeration system.

42. The system set forth in claim 20 wherein said selectively-connecting means includes means connected between said second port and said compressor input for vaporizing refrigerant passing therethrough.

43. The system set forth in claim 41 wherein said selectively-circulating means includes said compressor and said means for selectively connecting said compressor input to said second port.

44. The system set forth in claim 43 wherein said selectively-connecting means comprises means in parallel with said means for connecting said compressor input to said refrigeration system for selectively connecting said second port to said compressor input through said evaporator means.

45. The system set forth in claim 43 wherein said selectively-connecting means comprises means in parallel with said evaporator means for connecting said second port to said compressor input.

* * * * *